US006679533B1

(12) United States Patent
Bruner et al.

(10) Patent No.: US 6,679,533 B1
(45) Date of Patent: Jan. 20, 2004

(54) TAMPER-RESISTANT LATCH ASSEMBLY FOR SLIDABLE PARTITIONS WITH CHANNELIZED KEEPER

(75) Inventors: Gary M. Bruner, Jeffersonville, IN (US); William J. Adams, Louisville, KY (US)

(73) Assignee: Wirecrafters, L.L.C., Louisville, KY (US)

( * ) Notice: Subject to any disclaimer, the term of this patent is extended or adjusted under 35 U.S.C. 154(b) by 0 days.

(21) Appl. No.: 10/315,822

(22) Filed: Dec. 10, 2002

(51) Int. Cl.[7] ..... E05B 17/00

(52) U.S. Cl. ..... 292/346; 292/DIG. 2; 70/97; 70/450

(58) Field of Search ..... 292/346, DIG. 2, 292/340, 341.14; 70/102, 131, 142, 97, 450

(56) References Cited

U.S. PATENT DOCUMENTS

| | | | | | |
|---|---|---|---|---|---|
| 1,377,458 | A | * | 5/1921 | Block | |
| 1,853,456 | A | | 4/1932 | Ross | |
| 2,370,781 | A | | 3/1945 | Cullum | 292/346 |
| 2,638,370 | A | | 5/1953 | Price | 292/106 |
| 2,698,196 | A | | 12/1954 | Mangus | 292/300 |
| 2,749,164 | A | | 6/1956 | Kitzelman | 292/121 |
| 2,862,378 | A | | 12/1958 | Harris | 70/95 |
| 3,012,430 | A | | 12/1961 | Spork | 70/99 |
| 3,050,322 | A | | 8/1962 | Miller | 292/114 |
| 3,103,805 | A | | 9/1963 | Crosswell | 70/142 |
| 3,594,031 | A | * | 7/1971 | Ford | 292/140 |
| 4,005,890 | A | | 2/1977 | Murch | 292/346 |
| 4,024,739 | A | | 5/1977 | Kaufman | 70/97 |
| 4,057,935 | A | | 11/1977 | Rohrberg et al. | 49/56 |
| 4,170,885 | A | | 10/1979 | Lundgren | 70/97 |
| 4,438,641 | A | | 3/1984 | Levkov | 70/95 |
| 4,599,875 | A | | 7/1986 | De Forrest | 70/95 |
| 4,790,157 | A | | 12/1988 | Lin | 70/95 |
| 4,809,400 | A | * | 3/1989 | Allen | 16/82 |
| 4,865,370 | A | | 9/1989 | Francis | 292/340 |
| 5,127,690 | A | * | 7/1992 | Kim | 292/340 |
| 5,261,258 | A | | 11/1993 | Bunger | 70/56 |
| 5,356,185 | A | | 10/1994 | Cameron | 292/149 |
| 5,382,060 | A | | 1/1995 | O'Toole et al. | 292/46 |
| 5,388,875 | A | | 2/1995 | Fleming | 292/37 |
| 5,586,796 | A | | 12/1996 | Fraser | 292/346 |
| 5,595,409 | A | | 1/1997 | Fier et al. | 292/112 |
| 5,613,718 | A | * | 3/1997 | Lin | 292/346 |
| 5,664,445 | A | | 9/1997 | Chang | 70/34 |
| 5,816,629 | A | | 10/1998 | Donald | 292/254 |
| 6,196,034 | B1 | * | 3/2001 | Diebold et al. | 70/95 |

FOREIGN PATENT DOCUMENTS

| | | | | |
|---|---|---|---|---|
| DE | 32 02 107 A1 | * | 8/1983 | E05B/15/02 |
| GB | 2 224 065 A | * | 4/1990 | E05B/17/00 |

OTHER PUBLICATIONS

Multilock Product Literature (1968), 9 pages.
Wireway Husky Product Literature (1996), 1 page.
"Sliding Door Lock Receiver Cylinder Lock with insert", WireCrafters, 1 page.

* cited by examiner

*Primary Examiner*—Gary Estremsky
(74) *Attorney, Agent, or Firm*—Wood, Herron & Evans, L.L.P.

(57) ABSTRACT

An apparatus, latch assembly, keeper and installation method for use in slidable partition applications utilize a keeper formed of first and second angle members that are secured together in an overlapping relationship to define a U-shaped channel within which is disposed a tubular guard projection for protecting a latch from tampering by unauthorized personnel. Optional guard members may also inhibit access to the U-shaped channel when the slidable partition is engaged in a closed orientation.

38 Claims, 3 Drawing Sheets

TAMPER-RESISTANT LATCH ASSEMBLY FOR SLIDABLE PARTITIONS WITH CHANNELIZED KEEPER

FIELD OF THE INVENTION

The invention is generally related to latches, keepers and latch assemblies, and in particular to latches, keepers and latch assemblies for use with slidable partitions such as doors and gates.

BACKGROUND OF THE INVENTION

Latch assemblies, or latches, are commonly used to engage movable partitions such as doors or gates with other structural members, e.g., posts, walls, or panels, or other doors or gates. One use of a latch, for example, is in connection with a slidable partition such as a sliding gate.

A predominant use of a slidable partition is in selectively providing access to an enclosed or secured area. To this extent, oftentimes a lock is used in connection with a latch on a slidable partition to prevent the slidable partition from being opened by an unauthorized party. However, many latch and lock designs are susceptible to tampering, which may enable an unauthorized party to defeat a latch and/or lock to gain entry through the slidable partition.

For example, a number of sliding gate designs engage with a structural member (e.g., a fixed post or other partition) using a locking mechanism that operates a latch member to engage with a cooperative keeper on the structural member. The latch member typically projects outwardly from an end surface of the sliding gate in the direction of movement of the sliding gate. The locking mechanism is capable of moving the latch member between an unlocked position, where the latch member does not engage with the keeper, and a locked position, where the latch member engages with the keeper to prevent the sliding gate from disengaging from the structural member. Moreover, oftentimes the latch member is spring-loaded such that, when the locking mechanism is locked, but the sliding gate has not yet been moved to its closed position, the latch member deflects from its locked position to its unlocked position as the sliding gate is closed, and then springs back to the locked position once the sliding gate is moved to the fully closed position. Opening of the sliding gate requires actuation of the locking mechanism to move the latch member from the locked to the unlocked position.

While a spring-loaded latch member simplifies the operation of a sliding gate, such a latch member also often facilitates tampering by unauthorized parties. Specifically, oftentimes it is possible to access the latch member even when the sliding gate is closed, possibly permitting the latch member to be manually deflected to its unlocked position independent of the locking mechanism. For this reason, a significant amount of effort has been expended in the area of protecting a spring-loaded latch member from unauthorized tampering.

Conventional designs typically incorporate various guards to prevent external access to a spring-loaded latch, typically including cooperative members having opposing recesses and projections that serve to restrict external access to one or more sides of a latch. A number of designs do not, however, restrict access to all sides of a latch, and thus present a relatively greater security risk. Other designs that do restrict access to all sides of a latch are typically constructed of somewhat complicated interlocking members, which are more difficult and costly to manufacture. Further, in some designs the interlocking members may still provide gaps that an enterprising party may be able to exploit to gain unauthorized access through the gate. Moreover, many conventional designs are difficult to install or retrofit on existing structures.

One design that has overcome many of this drawbacks is disclosed in U.S. Pat. No. 6,196,034, which is assigned to the same assignee as the present invention, and which is incorporated by reference herein. In this design, a latch assembly incorporates a pair of overlapping tubular guard projections that are respectively secured to a pair of opposing structural members. The tubular designs of the projections define an enclosed area that is effectively isolated from all sides. As such, a latch member that projects through the enclosed area within the overlapping projections is substantially protected from unauthorized tampering.

In the aforementioned design, one of the overlapping tubular guard projections is typically secured to the end surface of one of the structural members, while the other projection is secured to a base plate of a keeper secured to the end surface of the other structural member. Each projection extends generally in the direction of the engagement axis along which the slidable partition slides, and both the end surface of the structural member, and the base plate oppose one another and extend perpendicular to the engagement axis.

The keeper also includes a transverse plate joined along an edge of the base plate and extending perpendicular to the base plate, running generally along a side face of the structural member. In addition, a mounting plate is joined to an opposite edge of the transverse plate from the base plate and extends generally parallel to, but in an opposite direction from, the base plate. When installed, the mounting plate overlies the end surface of the structural member to orient the base plate in a generally perpendicular relationship to the engagement axis.

Typically, the keeper is economical to construct, with the base, transverse and mounting plates being formed from a single piece of sheet metal bent along two parallel edges. In addition, the keeper is typically capable of being installed in either upright or inverted orientations, permitting the same keeper design to be used in both left- and right-handed installations, as well as in both inside and outside slider installations.

However, it has been found that, in an inside slider installation, the mounting plate of the keeper is accessible from the unsecured side of the enclosure when the slidable partition is in a closed position and secured via engagement of the latch assembly. As such, removable fasteners cannot be used to secure the mounting plate to the end surface of the structural member, otherwise an unauthorized person seeking to gain entrance through the slidable partition could simply remove the fasteners to disengage the keeper from the structural member.

Instead, non-removable, blind hole fasteners, such as Plusnut fasteners, are typically used to permanently secure the keeper to the structural member. Such fasteners, however, tend to be comparatively expensive and difficult to use. Furthermore, once installed, the keeper is no longer removable from the structural member, even by authorized service personnel.

Therefore, a significant need continues to exist for an improved mechanism for restricting access to a latch for a slidable partition such as a sliding gate, particularly for a mechanism that is less expensive and complicated than conventional designs.

SUMMARY OF THE INVENTION

The invention addresses these and other problems associated with the prior art by providing an apparatus, latch assembly, keeper and installation method for use in slidable partition applications in which the keeper is formed of first and second angle members that are secured together in an overlapping relationship to define a U-shaped channel within which is disposed a tubular guard projection for protecting a latch from tampering by unauthorized personnel.

In particular, a keeper consistent with the invention includes first and second angle members, and is configured to be secured to a structural member among a pair of structural members. One of the pair of structural members is disposed on a slidable partition and is configured to slide relative to the other structural member along an engagement axis. The first angle member includes first and second plates oriented generally perpendicular to one another, with the first plate configured for installation on one of the structural members to orient the second plate in a perpendicular relationship to the engagement axis. The second angle member includes third and fourth plates oriented generally perpendicular to one another, and the second angle member is configured to be secured to the first angle member with the second and third plates at least partially overlapping one another and the fourth plate extending generally parallel to the first plate to define a generally U-shaped channel between the first and second angle members. The keeper also includes a tubular guard projection secured to and extending from one of the second and third plates within the U-shaped channel and configured to extend along the engagement axis when the first plate is installed on the structural member.

Additionally, an apparatus and a latch assembly utilize an additional tubular guard projection that is configured to be secured to the end surface of the other structural member from that to which the keeper is secured. The additional tubular guard projection circumscribes a latch member receiving aperture defined in an end surface of the other structural member, and extends outwardly from the end surface and in a direction generally along the engagement axis. The tubular guard projections are also sized and configured relative to one another to overlap along the engagement axis when the structural members are secured to one another.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention. dr

DETAILED DESCRIPTION

Figure 1:
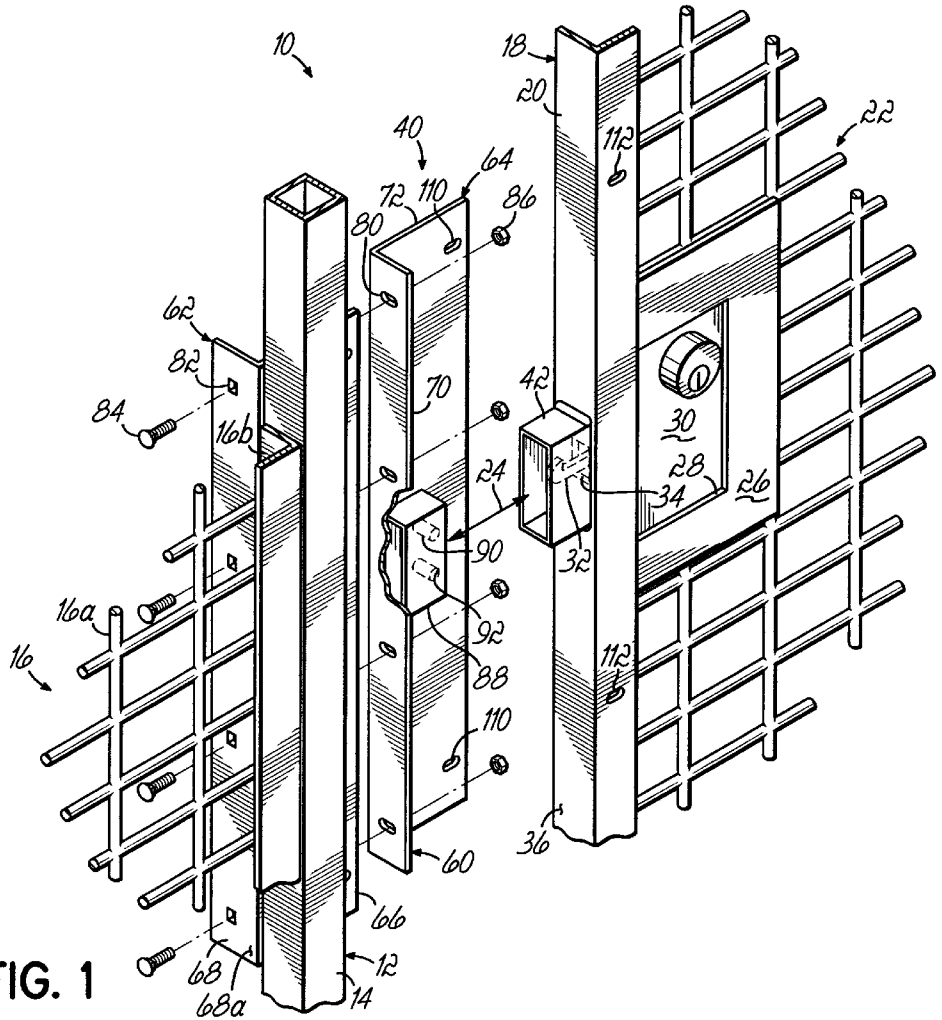
FIG. 1 is an exploded fragmentary perspective view of an enclosure consistent with the invention, taken from an unsecured side of the enclosure, with portions of a latch assembly used therein cut away.

Turning to the Drawings, wherein like numbers denote like parts throughout the several views, FIG. 1 illustrates an enclosure 10 consistent with the invention. Enclosure 10 includes a fixed partition 12 including a tubular post 14 and a wire mesh panel 16, and a slidable partition 18 defined by a wire mesh panel including an angle frame 20 and wire mesh 22. Each of partitions 12, 18 in the illustrated embodiment are constructed from woven wire mesh partitions, e.g., the #840 style partitions available from WireCrafters, L.L.C. of Louisville, Ky., the assignee of the present invention.

In the illustrative embodiment, wire mesh panel 16 includes wire mesh 16*a* framed by a 1¼"×1¼"×1/8" steel angle frame 16*b*. In addition, panel 16 is bolted to post 14 through angle frame 16*b* using ⅜-16×3" bolts (not shown). Likewise, 1¼"×1¼"×⅛" steel angle is used for angle frame 20.

Slidable partition 18 is a sliding gate that is slidable along an engagement axis represented at 24. The sliding gate includes a lock mounting plate 26 having a lock assembly receiving aperture 28 within which is mounted a lock assembly 30. Lock assembly 30 is typically a mortise cylinder lock, which includes a hooked latch member 32 that projects through a latch member receiving aperture 34 formed in an end face 36 of angle frame 20. Lock assembly 30 is, for example, a No. W3830 mortise cylinder lock available from Marks Lock Co.

Partition 12 is typically secured at a fixed position, e.g., so that post 14 forms a fixed post relative to which the sliding gate 18 moves along the engagement axis. However, it should be appreciated that partition 12 may also be slidable as well. Moreover, rather than a partition, a slidable partition may engage with any other suitable structural members as is known in the art. Further, it should be appreciated that the lock assembly and associated hooked latch member may be disposed on partition 12 or other suitable structure, rather than on sliding gate 18.

In general, it should be appreciated that the principles of the invention may be utilized to secure any pair of structural members together, where one of the structural members is disposed on a slidable partition. Other types of slidable partitions for which the invention may be utilized include other forms of sliding gates, slidable doors, slide up gates etc. It will be appreciated that the embodiment described herein is but one suitable embodiment, and the invention should therefore not be limited solely to that which is specifically disclosed herein.

A latch assembly 40 is used to secure slidable partition 18 to post 14 of partition 12. Latch assembly 40 includes a first tubular guard projection 42 that fully circumscribes the latch member receiving aperture 34 in end face 36 of frame 20.

Projection 42 is illustrated in FIG. 1 as being welded to end face 36. However, it should be appreciated that other manners of securing projection 42 to structural member 20, e.g., fasteners, may be used in the alternative.

Latch assembly 40 also includes a keeper 60 mounted to post 14 of partition 12. Keeper 60 is a channelized keeper formed from a pair of overlapping angle members 62, 64, that define a U-shaped channel. Angle member 62 includes a mounting plate 66 and a backing plate 68, while angle member 64 includes a base plate 70 and an outer plate 72. Each angle member 62, 64 may be constructed, for example, from #10 sheet metal bent along a longitudinal edge such that plates 66, 68 and plates 70, 72, are generally perpendicular to one another.

In other embodiments, alternate constructions of the angle members may be used. For example, other materials and manufacturing methods may be used to form members 62, 64. Furthermore, plates 68, 70 need not be configured to completely overlap one another. More than two members may also be used to form a channelized structure as is formed by angle members 62, 64.

Figure 2:
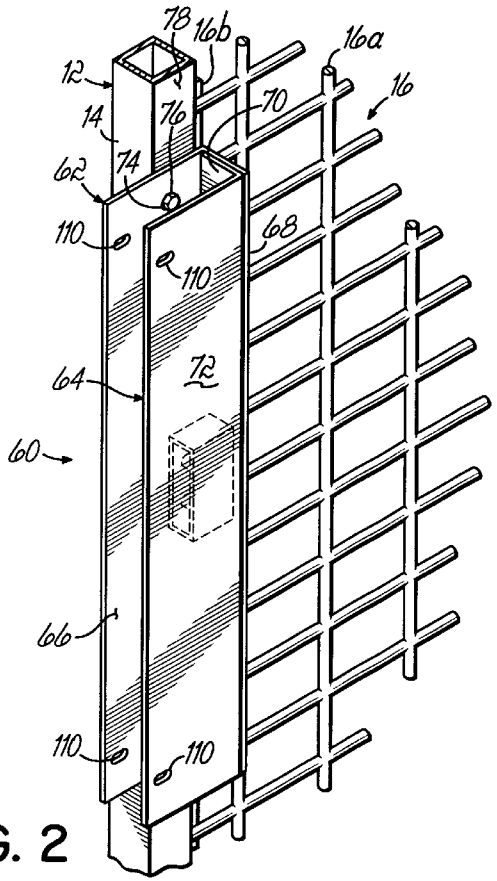
FIG. 2 is a perspective view of the fixed post and assembled keeper from FIG. 1, taken from the secured side of the enclosure.
Figure 5:
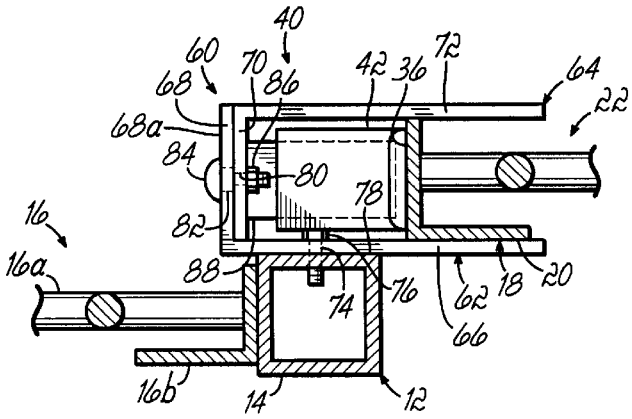
FIG. 5 is a cross-sectional view taken through lines 5—5 of FIG. 3.

Angle member 62 also includes a plurality of mounting apertures 74 disposed on mounting plate 66 (e.g., four apertures) configured to receive fasteners 76 for use in securing the angle member to a side surface 78 of post 14 (best shown in FIGS. 2 and 5). Fasteners 76 may be threaded fasteners such as self-drilling screws, sheet metal screws, self-tapping screws, bolts, tamper-proof fasteners, etc., or alternatively, non-threaded fasteners such as blind hold fasteners, rivets, etc. In alternate embodiments, other manners of securing the angle member to the post may be used, e.g., welding, adhesives, etc.

Angle member 62 also includes disposed on backing plate 68 a plurality of mounting apertures 80, which align with a plurality of mounting apertures 82 on base plate 70 of angle member 64 to secure plates 68 and 70 in an overlapping relationship through the use of pairs of fasteners 84, 86. When overlapped, angle members 62, 64 form a channelized keeper in which a generally U-shaped channel (in cross-section) is defined for the keeper.

Fasteners 84 may be configured, for example, as carriage head bolts, or another form of threaded fastener that is tamper-proof from the perspective of the outer surface 68*a* of backing plate 68 (e.g., blind hole fasteners, rivets, threaded fasteners with tamper-proof heads, etc.), given that the heads of the fasteners are accessible to unauthorized persons in outside installations (i.e., where keeper 60 is mounted to the unsecured side of an enclosure). Fasteners 86 may be configured as nuts that engage with fasteners 84. In this regard, mounting apertures 82 may be square in shape to engage, the square shank section of a carriage head bolt, while mounting apertures 80 may be oblong in shape along a lateral direction to permit plates 68, 70 to be adjusted relative to one another to better align angle member 64 for engagement with a latching member.

It will be appreciated that, while plate 68 is shown in an outside orientation relative to plate 70, the opposite overlapping relationship may be used in the alternative. Moreover, other mounting aperture configurations may be used on either of angle members 62, 64.

Also mounted to base plate 70 of angle member 64 is a second tubular guard projection 88, which projects outwardly from the base plate along the general direction of engagement axis 24. Projection 88 is oriented to directly oppose projection 42 mounted to angle frame 20. In alternate embodiments, projection 88 may be secured to plate 68 of angle member 62.

In addition to providing a support for projection 88, angle member 64 provides additional tamper resistance by virtue of its extending a substantial distance both above and below projection 88. As such, access to projection 88 through the wire mesh panel 16 is made more difficult by virtue of the configuration of angle member 64. The length of base and outer plates 70, 72 of angle member 64, as well as those of mounting and backing plates 66, 68 of angle member 62 may vary for different embodiments, with relatively longer lengths providing added protection.

Projections 42, 88 are each typically formed of tubular material, e.g., #14 sheet metal formed into a tubular construction and welded along a seam. Other materials and constructions may be used in the alternative, e.g., formed flat steel, round steel, or plastic pipe, among others.

Figure 3:
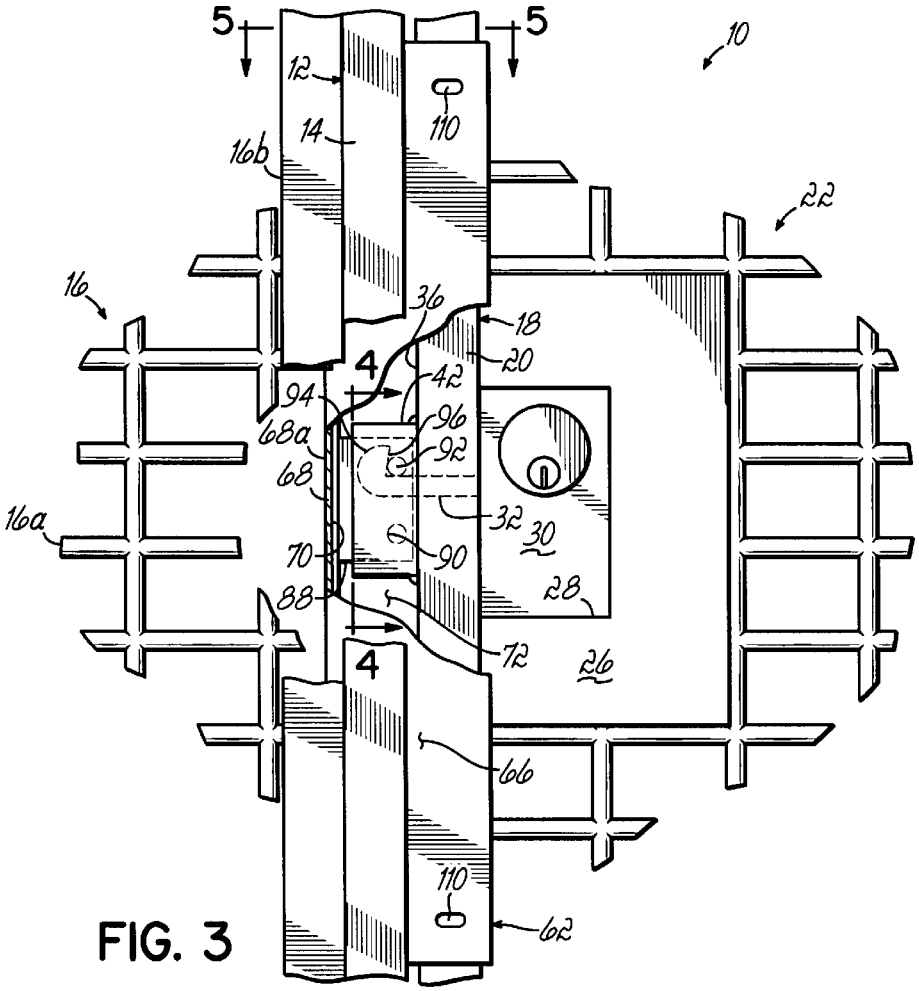
FIG. 3 is a fragmentary side elevational view of the unsecured side of the enclosure of FIG. 1, showing the sliding gate thereof disposed in a closed position relative to the fixed post.

Projection 88 is utilized to at least partially enclose a catch mechanism that engages hooked latch member 32 on slidable partition 18. As best shown in FIG. 3, for example, projection 88 may include one or more pairs of mounting apertures 90 within which are mounted one or more spring pins 92 that extend across the width of the projection, and in a direction generally perpendicular to engagement axis 24.

As will be discussed in greater detail below, only one such pin 92 is required to engage with the hooked latch member 32. However, in some embodiments it may be desirable to provide a pair of pins disposed roughly equidistant from a horizontal center line that vertically bisects the projection so that keeper 60 may be installed in either an upright or an inverted orientation to accommodate sliding gates that overlap partition 12 on either of inside or outside sides thereof, as well as sliding gates that close on their left or right edges. Moreover, it should be appreciated that other catch mechanisms may be utilized to engage hooked latch member 32 in the alternative, e.g. pins formed of other bar stock, flanges or tabs on the projection itself, etc.

Figure 4:
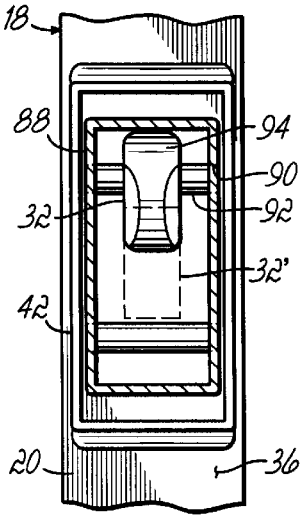
FIG. 4 is a cross-sectional view taken through lines 4—4 of FIG. 3.

With the configuration of projection 42 and projection 88 respectively mounted to angle frame 20 and post 14, the projections are configured to substantially overlap one another when slidable partition 18 is moved to a closed position immediately adjacent partition 12. For example, as illustrated in FIG. 3, slidable partition 18 is illustrated in a closed position, where hooked latch member 32 has been inserted into keeper 60 to engage with one of pins 92 forming the catch mechanism. Specifically, as best illustrated in FIG. 4, when slidable partition 18 is moved toward partition 12 along the engagement axis, a cammed surface 94 of hooked latch member 32 engages pin 92 and deflects to the position illustrated at 32'. Once the cammed surface 94 passes pin 92, however, the spring bias on hooked latch member 32 causes the hooked latch member to return to the locked position illustrated at 32 in FIG. 4. As shown in FIG. 3, an engagement surface 96 on the hooked latch member engages pin 92, thus securing angle frame 20 and slidable partition 18, to post 14.

In addition, it may be seen from FIG. 4 that projections 42, 88 are provided with cooperating cross-sections that generally provide a telescoping arrangement between the projections when the slidable partition is closed. Specifically, the cross-sectional shapes of the respective projections 42, 88 have corresponding perimeters such that a relatively tight fit between the projections is provided when one projection overlaps the other. In the illustrated embodiment, each projection 42, 88 includes a generally rectangular cross-section, although other shapes, e.g., other polygonal cross-sections, or a circular or elliptical cross-section, may also be used in the alternative.

Also, the respective projections 42, 88 may be sized relative to one another to provide different relative gaps therebetween. FIG. 4, for example, illustrates an embodiment where a relatively small gap (e.g., about 0.042" on each side) is provided between the left and right-sides of each projection 42, 88, with a relatively larger gap (e.g., about 0.167" on each side) between the top and bottom sides thereof to accommodate any sagging or misalignment between the slidable partition and the fixed post. It should be appreciated that any degree of tolerance between the respective sides of the projections may be provided consistent with the invention, with smaller gaps providing greater security and tamper resistance, and with larger gaps facilitating closing of the slidable partition.

Returning to FIG. 3, it can also be seen that the respective lengths of each projection 42, 88 along the engagement axis 24 may be generally the same (e.g., within about 80% of one, another) such that the projections overlap substantially along the entire exposed region between base plate 70 of keeper 60 and end face 36 of structural member 20. As such, the base plate 70 and end face 36 may cooperate with the respective end surfaces of projections 42, 80 to further inhibit access to the enclosed area within projections 42, 88. In the alternative, various degrees of overlap may be provided, albeit with less resistance to tampering.

To install keeper 60 of latch assembly 40, mounting plate 66 of angle member 62 is secured to side surface 78 of post 14 using a plurality of fasteners (e.g., self-drilling screws) 76 secured to post 14 through mounting apertures 74. Thereafter, angle member 64 is secured to angle member 62 by overlapping plates 68, 70, aligning mounting apertures 80, 82, fitting carriage head bolts 84 through apertures 80, 82, and threading nuts 86 onto the ends of bolts 84. Prior to tightening nuts 86, angle member 64 may be adjusted relative to angle member 62 due to the oblong shape of apertures 80, e.g., to better align projection 88 with projection 42.

Once installed, and as shown in FIG. 5, not only do projections 42, 88 overlap to such an extent that tampering with the latch member 32 is substantially prevented, but also tampering with keeper 60 is also substantially restricted.

Figure 7:
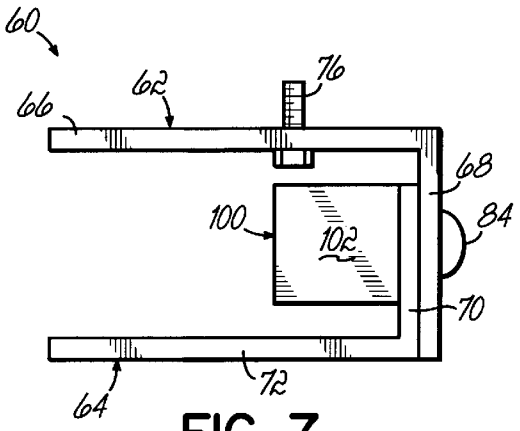
FIG. 7 is a top plan view of the keeper of FIG. 6, illustrating an end cap installed thereon.
Figure 6:
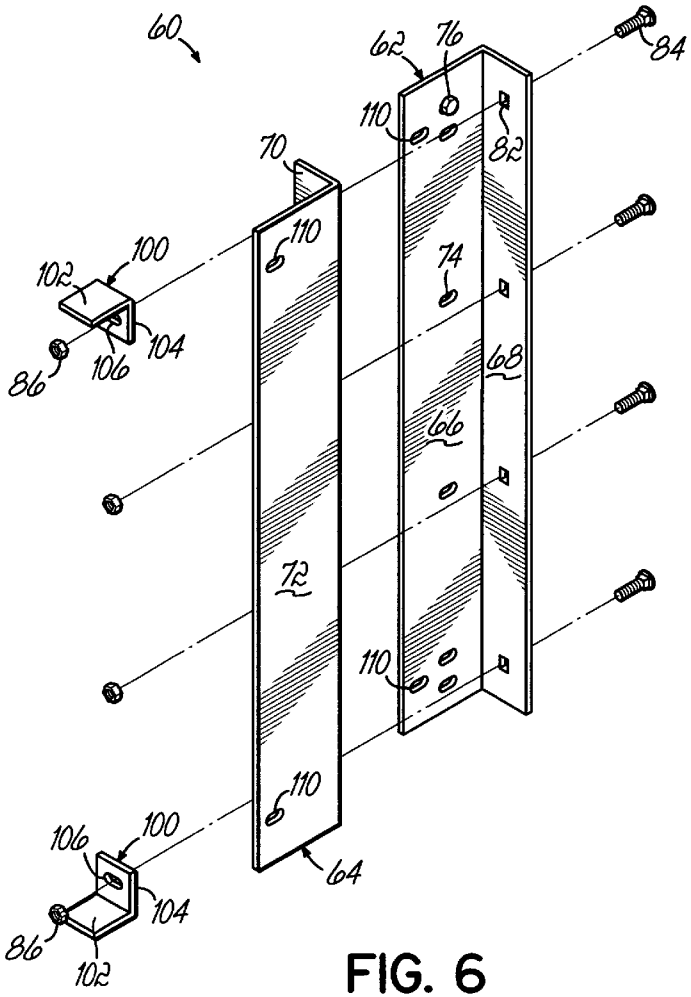
FIG. 6 is an exploded fragmentary perspective view of the keeper of FIG. 1, illustrating the incorporation of optional end caps therewith.

In some embodiments, it may be desirable to further include one or more guard members to further restrict access to any or all of the fasteners used to secure an angle member to a structural member and/or to secure two angle members to one another. For example, FIGS. 6 and 7 illustrate the use of end caps 100 to inhibit access to the U-shaped channel from either end thereof. Each end cap 100 includes a restrictor flange 102 that extends transversely to a mounting flange 104 within which is disposed a mounting aperture 106.

Each end cap 100 may be formed of sheet metal bent along an edge thereof to form orthogonally-oriented flanges 102, 104. Other materials, fabrication processes and configurations may be used in the alternative.

As best shown in FIG. 6, end caps 100 are typically installed contemporaneously with the assembly of angle members 62, 64, as the end caps are secured using the same fasteners 84, 86 used to secure the angle members to one another. In other implementations, end caps 100 may be mounted in other orientations (e.g., inverted), and different numbers of end caps may be used. Other manners of mounting the end caps to the angle members may also be used, e.g., through welding, or through the integral formation thereof on one of the angle members.

As best shown in FIG. 7, once installed, access to the fasteners in the U-shaped channel is substantially restricted, particularly when a slidable partition is in a closed orientation and latch member 32 is engaged with pin 92.

It should be appreciated that other manners of restricting access to the fasteners may be used in the alternative. For example, either or both of angle members 62, 64 may incorporate additional flanges, tabs or ears that may be bent to a transverse orientation relative to the respective plates 66, 68, 70 or 72 so as to at least partially enclose the top or bottom of the U-shaped channel formed by the keeper. It should be appreciated, however, that restricting access to the fasteners using additional structure may not be required in many embodiments, as the relatively narrow spacing in the U-shaped channel when a slidable partition is engaged in a closed orientation makes it extremely difficult to reach the fasteners in the channel. Particularly for the innermost fasteners (those closest to projection 88), the confined nature of the U-shaped channel would make it extremely difficult to obtain suitable range of motion and leverage to loosen and remove such a fastener.

It may also be desirable to support supplemental and/or alternative locking mechanisms for a latch assembly consistent with the invention. For example, as best illustrated in FIGS. 1–3, it may be desirable to incorporate one or more lock receiving apertures 110 on angle member 62 and/or angle member 64 for use in receiving a padlock or other type of locking mechanism (not shown). To secure keeper 60, and thus post 14 of partition 12, to slidable partition 18, one or more complementary apertures 112 may be disposed on structural member 20 of slidable partition 18. When slidable partition 18 is moved to a closed position, at least one set of complementary apertures 110, 112 align with one another, thus permitting a padlock or other locking mechanism to pass through the aligned apertures and secure the partitions 12, 18 to one another. Any of apertures 110, 112 may be oblong in shape, or otherwise oversized to facilitate the alignment of the apertures with one another.

Various modifications may be made to the illustrated embodiments without departing from the spirit and scope of the invention. For example, the latch member, and thus the latch member receiving aperture around which a projection circumscribes, may be disposed on either the slidable partition or on the other structural member to which the slidable partition is secured. As another alternative, it may be desirable to include a stop on each of the slidable partition and the opposing structural member to limit the travel of the slidable partition. Also, a guide mechanism may also be used on the slidable partition to assist in centering the guard projections relative to one another.

Other modifications may be made consistent with the invention. Therefore, the invention lies in the claims hereinafter appended.

What is claimed is:

1. A latch assembly for securing a first structural member to a second structural member, wherein one of the first and second structural members is disposed on a slidable partition configured to slide relative to the other structural member along an engagement axis, and the first structural member including a latch member receiving aperture defined in an end surface thereof, the latch assembly comprising:

(a) a first tubular guard projection configured to be secured to the end surface of the first structural member and to circumscribe the latch member receiving aperture, the first tubular guard projection configured to extend outwardly from the end surface and in a direction generally along the engagement axis when secured to the first structural member; and (b) a keeper configured to be secured to the second structural member, the keeper including:

(i) a first angle member including first and second plates oriented generally perpendicular to one another, the first plate configured for installation on the second structural member to orient the second plate in a perpendicular relationship to the engagement axis;

(ii) a second angle member including third and fourth plates oriented generally perpendicular to one another, wherein the second angle member is configured to be secured to the first angle member with the second and third plates at least partially overlapping one another and the fourth plate extending generally parallel to the first plate to define a generally U-shaped channel between the first and second angle members; and (iii) a second tubular guard projection secured to and extending from one of the second and third plates within the U-shaped channel and configured to extend along the engagement axis when the keeper is secured to the second structural member, wherein the first and second tubular guard projections are sized and configured relative to one another to overlap along the engagement axis when the first structural member is secured to the second structural member.

2. The latch assembly of claim 1, wherein the first structural member is disposed on the slidable partition, wherein the latch assembly further comprises:

(a) a catch mechanism secured to the keeper and at least partially enclosed within the second tubular guard projection; and (b) a lock assembly configured to be secured to the slidable partition, the lock assembly including a latch member configured to engage the catch mechanism and to extend through the latch member receiving aperture and the first tubular guard projection.

3. The latch assembly of claim 2, wherein the catch mechanism includes first and second transverse pins extending across the second tubular guard projection in a direction generally perpendicular to the engagement axis.

4. The latch assembly of claim 1, wherein the first tubular guard projection is configured to be welded to the end surface of the first structural member.

5. The latch assembly of claim 1, wherein the first tubular guard projection includes at least one mounting flange configured to receive a fastener that secures the first tubular guard projection to the end surface of the first structural member.

6. The latch assembly of claim 1, wherein the first and second tubular guard projections having cooperating cross-sections.

7. The latch assembly of claim 6, wherein the first and second tubular guard projections are each rectangular in cross section.

8. The latch assembly of claim 1, wherein the first and second tubular guard projections have generally the same length along the engagement axis such that, when the first structural member is secured to the second structural member, the first and second tubular guard projections overlap generally throughout an exposed region between the base plate of the keeper and the end surface of the first structural member.

9. The latch assembly of claim 1, wherein the second tubular guard projection is secured to the third plate, and wherein the third plate is intermediate the second plate and the U-shaped channel.

10. The latch assembly of claim 1, wherein the first and second angle members are secured to one another by a plurality of fasteners extending through a plurality of aligned mounting apertures disposed in each of the second and third plates.

11. The latch assembly of claim 10, wherein the plurality of fasteners includes a plurality of carriage head bolts and a plurality of nuts, wherein the plurality of nuts are disposed within the U-shaped channel.

12. The latch assembly of claim 1, wherein the first plate includes a plurality of mounting apertures for receiving a plurality of fasteners to secure the first plate to the second structural member.

13. The latch assembly of claim 1, wherein the first structural member is disposed on the slidable partition, wherein the slidable partition comprises a sliding gate, and wherein the second structural member comprises a fixed post.

14. The latch assembly of claim 1, wherein each of the angle members is formed of sheet metal bent to define the first, second, third and fourth plates.

15. The latch assembly of claim 1, further comprising at least one guard member coupled to the keeper and configured to inhibit access to the U-shaped channel from an end thereof.

16. The latch assembly of claim 15, wherein the guard member comprises an end cap including a mounting flange and a transverse flange extending transversely thereto, and wherein the end cap is coupled to the keeper by a fastener extending through the mounting flange and the second and third plates.

17. The latch assembly of claim 1, wherein at least one of the angle members includes a lock receiving aperture configured to align with a complementary aperture disposed on the first structural member such that a locking mechanism may extend through the lock receiving aperture and complementary aperture to secure the first structural member to the second structural member.

18. A keeper for use with a latch assembly to secure a first structural member to a second structural member, wherein one of the first and second structural members is disposed on a slidable partition configured to slide relative to the other structural member along an engagement axis, the keeper comprising:

(a) a first angle member including first and second plates oriented generally perpendicular to one another, the first plate configured for installation on one of the structural members to orient the second plate in a perpendicular relationship to the engagement axis;

(b) a second angle member including third and fourth plates oriented generally perpendicular to one another, wherein the second angle member is configured to be secured to the first angle member with the second and third plates at least partially overlapping one another and the fourth plate extending generally parallel to the first plate to define a generally U-shaped channel between the first and second angle members; and (c) a tubular guard projection secured to and extending from one of the second and third plates within the U-shaped channel and configured to extend along the engagement axis when the first plate is installed on the structural member.

19. The keeper of claim 18, further comprising a catch mechanism secured to the keeper and at least partially enclosed within the tubular guard projection.

20. The keeper of claim 19, wherein the catch mechanism includes first and second transverse pins extending across the tubular guard projection in a direction generally perpendicular to the engagement axis.

21. The keeper of claim 18, wherein the tubular guard projection is secured to the third plate, and wherein the third plate is intermediate the second plate and the U-shaped channel.

22. The keeper of claim 18, wherein the first and second angle members are secured to one another by a plurality of fasteners extending through a plurality of aligned mounting apertures disposed in each of the second and third plates.

23. The keeper of claim 22, wherein the plurality of fasteners includes a plurality of carriage head bolts and a plurality of nuts, wherein the plurality of nuts are disposed within the U-shaped channel.

24. The keeper of claim 18, wherein the first plate includes a plurality of mounting apertures for receiving a plurality of fasteners to secure the first plate to the structural member.

25. The keeper of claim 18, wherein each of the angle members is formed of sheet metal that has been bent to define the first, second, third and fourth plates.

26. The keeper of claim 18, further comprising at least one guard member configured to inhibit access to the U-shaped channel from an end thereof.

27. The keeper of claim 26, wherein the guard member comprises an end cap including a mounting flange and a transverse flange extending transversely thereto, and wherein the end cap is coupled to the keeper by a fastener extending through the mounting flange and the second and third plates.

28. An apparatus, comprising:

(a) a first structural member and a second structural member, wherein at least one of the first and second structural members is disposed on a slidable partition configured to slide relative to the other structural member along an engagement axis, and the first structural member including a latch member receiving aperture defined in an end surface thereof;

(b) a first tubular guard projection secured to the end surface of the first structural member and circumscribing the latch member receiving aperture, the first tubular guard projection extending outwardly from the end surface and in a direction generally along the engagement axis; and (c) a keeper configured to be secured to the second structural member, the keeper including:

(i) a first angle member including first and second plates oriented generally perpendicular to one another, the first plate configured for installation on the second structural member to orient the second plate in a perpendicular relationship to the engagement axis;

(ii) a second angle member including third and fourth plates oriented generally perpendicular to one another, wherein the second angle member is configured to be secured to the first angle member with the second and third plates at least partially overlapping one another and the fourth plate extending generally parallel to the first plate to define a generally U-shaped channel between the first and second angle members; and (iii) a second tubular guard projection secured to and extending from one of the second and third plates within the U-shaped channel and configured to extend along the engagement axis when the keeper is secured to the second structural member, wherein the first and second tubular guard projections are sized and configured relative to one another to overlap along the engagement axis when the first structural member is secured to the second structural member.

29. A method of installing a keeper to a first structural member for use with a latch assembly to secure the first structural member to a second structural member, wherein one of the first and second structural members is disposed on a slidable partition configured to slide relative to the other structural member along an engagement axis, the method comprising:

(a) mounting a first plate disposed on a first angle member to a side surface of the first structural member, wherein the first angle member additionally includes a second plate oriented generally perpendicular to the first plate so as to be oriented in a perpendicular relationship to the engagement axis when the first plate is secured to the side surface of the first structural member; and (b) securing a second angle member that includes third and fourth plates oriented generally perpendicular to one another to the first angle member with the second and third plates at least partially overlapping one another and with the fourth plate extending generally parallel to the first plate to define a generally U-shaped channel between the first and second angle members, wherein one of the second and third plates includes a tubular guard projection extending into the U-shaped channel and configured to extend along the engagement axis.

30. The method of claim 29, wherein the tubular guard projection is secured to the third plate, and wherein the third plate is intermediate the second plate and the U-shaped channel.

31. The method of claim 29, wherein securing the second angle member to the first angle member includes securing the first and second angle members together with a plurality of fasteners extending through a plurality of aligned mounting apertures disposed in each of the second and third plates.

32. The method of claim 31, wherein the plurality of fasteners includes a plurality of carriage head bolts and a plurality of nuts, wherein the plurality of nuts are disposed within the U-shaped channel.

33. The method of claim 31, wherein the mounting apertures disposed in at least one of the second and third plates are oblong, and wherein securing the second angle member to the first angle member further includes adjusting the orientation of the second angle member relative to the first angle member prior to tightening the plurality of fasteners.

34. The method of claim 29, wherein mounting the first plate to the side surface of the first structural member includes driving a plurality of threaded fasteners through a plurality of mounting apertures disposed in the first plate.

35. The method of claim 34, wherein the plurality of fasteners are self-drilling screws.

36. The method of claim 29, wherein mounting the first plate to the side surface of the first structural member is performed before securing the second angle member to the first angle member.

37. The method of claim 29, further comprising securing at least one guard member to the keeper to inhibit access to the U-shaped channel from an end thereof.

38. The method of claim 37, wherein the guard member comprises an end cap including a mounting flange and a transverse flange extending transversely thereto, and wherein securing the guard member to the keeper uses a fastener extending through the mounting flange of the end cap and the second and third plates.

* * * * *